US006089974A

United States Patent [19]

Ahmad

[11] Patent Number: 6,089,974

[45] Date of Patent: Jul. 18, 2000

[54] PRE-PRINTED FORM BOOK HAVING DUAL PURPOSE STORAGE POUCH AND MAILING ENVELOPE ATTACHED AS A COVER THERETO AND METHOD FOR USE

[76] Inventor: Faisal Ahmad, 7232 Abrams Place Ct., Dallas, Tex. 75231

[21] Appl. No.: 09/399,560

[22] Filed: Sep. 20, 1999

[51] Int. Cl.[7] ..... B41L 1/20

[52] U.S. Cl. ..... 462/55; 462/64; 462/71; 283/63.1; 283/116

[58] Field of Search ..... 462/2, 7, 17, 18, 462/55, 57, 62, 63, 64, 65, 84, 71; 283/63.1, 64, 64.1, 116, 117

[56] References Cited

U.S. PATENT DOCUMENTS 3,032,355 5/1962 Zalkind ..... 462/55

4,512,595 4/1985 Breen ..... 462/55 X 4,730,848 3/1988 McCormick ..... 462/55

5,295,906 3/1994 Skees ..... 462/55 X

*Primary Examiner*—Willmon Fridie, Jr.

*Attorney, Agent, or Firm*—Jenkens & Gilchrist, PC

[57] ABSTRACT

A pre-printed form book includes a binding and pre-printed forms having a plurality of predetermined spaces for receiving manually written information thereon. The pre-printed form book further includes the improvement of an envelope removably attached to the binding for storage of one or more said pre-printed forms having information received thereon and having been detachably removed from the binding. The envelope, containing the detached pre-printed form with information received thereon, is pre-addressed and may be detachably removed from the binding for mailing to a remote location.

14 Claims, 3 Drawing Sheets

124

110
117
119
112
113
BUSINESS REPLY MAIL
Joe Blow Enterprises
This side of form
1234 Whatever Street
Kokomo, IN 46974
NO POSTAGE
NECESSARY
IF MAILED
IN THE
UNITED STATES
116
122
124
114
118

112

PRE-PRINTED FORM BOOK HAVING DUAL PURPOSE STORAGE POUCH AND MAILING ENVELOPE ATTACHED AS A COVER THERETO AND METHOD FOR USE

BACKGROUND OF THE PRESENT INVENTION

1. Technical Field

The present invention relates generally to pre-printed form books, in general, and, in particular, to a triad bound form book having a dual purpose storage pouch and mailing envelope attached as a cover thereto.

2. Background and Objects of the Present Invention

Form books known as manifold books or triad bound books are well known in the art of printed form books. Such books typically include a binding to secure the pre-printed forms therein and a front and back cover. The books typically include a plurality of sets of pre-printed forms removably attached to the binding. Each set of forms typically comprises at least two or more copies of the pre-printed form, wherein data may be written in predetermined positions on the top form and the written information is passed via carbon paper or carbonless paper to subsequent pre-printed forms in the same set adjacent to and below the top form. Typically, a stiff sheet of paper or cardboard is inserted between the sets of pre-printed forms such that information that is written on the first set of pre-printed forms does not transfer down into the second set of pre-printed forms.

Form books of the aforementioned type are frequently used by service oriented businesses, including home repair service persons who may be providing services such as repair of appliances, air conditioning systems, plumbers, electricians, etc., or may be used in the medical profession by physicians, opticians, etc., who see patients and take detailed information based on an interview with the patient and need to record such information. Frequently, in either the service person situation or the medical application, the customer or patient is given a copy of the service report or patient report, a copy is retained in the form book for future reference of the individual taking the information, and a third copy is forwarded to a remote location, perhaps for purposes of generating an invoice for the services rendered or for processing an insurance claim.

In the past, the copies which were to be forwarded to a remote location were subject to being lost or misdirected resulting in delayed billings or delayed insurance reimbursements. A need exists for a form book and method of use whereby the copies to be forwarded to a remote location are (1) stored (or filed) until such time is appropriate for forwarding and, (2) forwarding to the remote location in the most efficient manner.

The present invention meets this need by providing a storage envelope that functions as a dual purpose storage pouch (filing system) and future mailing envelope attached as a cover for the form book of the present invention.

BRIEF DESCRIPTION OF THE DRAWINGS

The disclosed invention will be described with reference to the accompanying drawings, which show important sample embodiments of the invention and which are incorporated in the specification hereof by reference, wherein.

DETAILED DESCRIPTION OF THE PRESENTLY PREFERRED EXEMPLARY EMBODIMENTS

Figure 1:
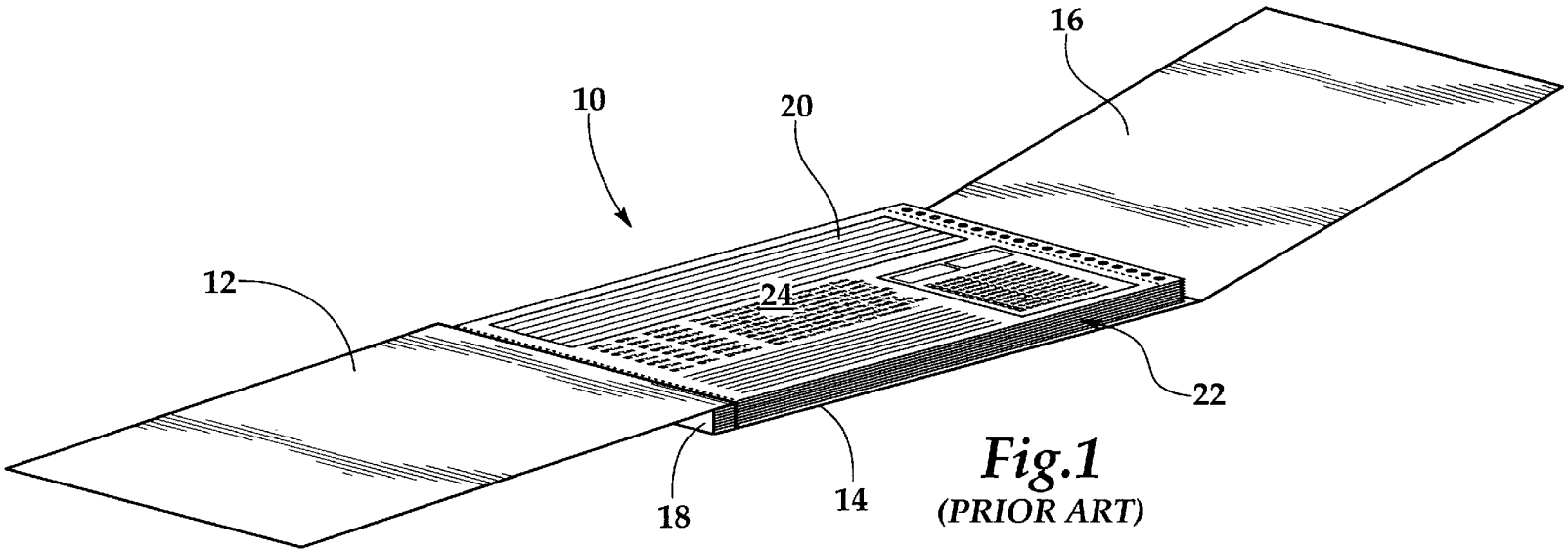
Fig.1 (PRIOR ART)
FIG. 1 is a perspective view of the prior art form book.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Reference is now made to the drawings, wherein like reference characters, like or similar parts throughout the figures.

Referring now to FIG. 1, in particular, therein is illustrated a prior art pre-printed form book 10 having a front cover 12, a back cover 14, a foldable extension of the back cover 16 and a binding 18. Detachably attached to binding 18 are a plurality of sets of pre-printed forms 20 and 22. The first set of pre-printed forms 20 includes a first pre-printed form 24 having a plurality of predetermined spaces for receiving manually written information thereon and at least one or more pre-printed forms positioned adjacent to and below pre-printed form 24. Each of said second and third pre-printed forms having a plurality of predetermined spaces for receiving manually written information transferred by means of carbon paper or carbonless paper from the first pre-printed form.

Figure 2:
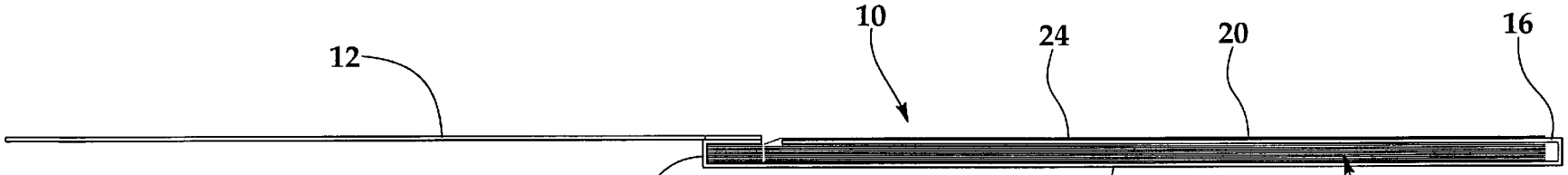
Fig.2 (PRIOR ART)
FIG. 2 is a side view of the prior art form book of FIG. 1.

Referring now to FIG. 2, wherein the foldable extension of the back cover 16 is illustrated folded into the form book and the first set of pre-printed forms 20 is illustrated positioned above foldable extension 16. As is well known in the art, when information is manually written on top pre-printed form 24, the information is transferred to the second and third sheet of the form set and extendable cover 16 prevents transference of the manually written information to the second set of pre-printed forms 22 positioned below extendable cover 16.

Prior art form book 10 is known in the art as a manifold book or a triad bound book and is frequently used by service oriented businesses. Typical uses are made by repair service persons who provide such services as repair of appliances, air conditioning systems, plumbers, and electricians, etc., who, after performing a service, need to leave a detailed report of the service performed with the customer. The user of form book 10 typically records certain information by manually writing the information in certain predetermined spaces on the pre-printed form 24 and detaches one of the pages of the pre-printed set and leaves it with a customer. An additional copy typically remains connected to the binding in the book and a third copy is detached from the binding and forwarded to an accounting department for generation of an invoice for the services rendered.

Another possible use of form book 10 is made by the medical profession. Physicians, opticians, nurses, etc., typically see patients and take detailed information based on an interview and/or examination of the patient. During such an examination and/or interview, the medical personnel records information in certain predetermined spaces on pre-printed form 24. Frequently, the physician gives a copy of the pre-printed form containing the information to the patient, keeps a copy in the form book 10 and may forward a copy to an insurance company for the purposes of processing an insurance claim.

It will be understood by those in the art that there are numerous other types of businesses which use prior art form books 10 in a similar manner.

Frequently, in the past, the copies which were to be forwarded by the service person or medical personnel to a remote location were subject to being lost or misdirected resulting in delayed billings or delayed insurance reimbursement.

Figure 3:
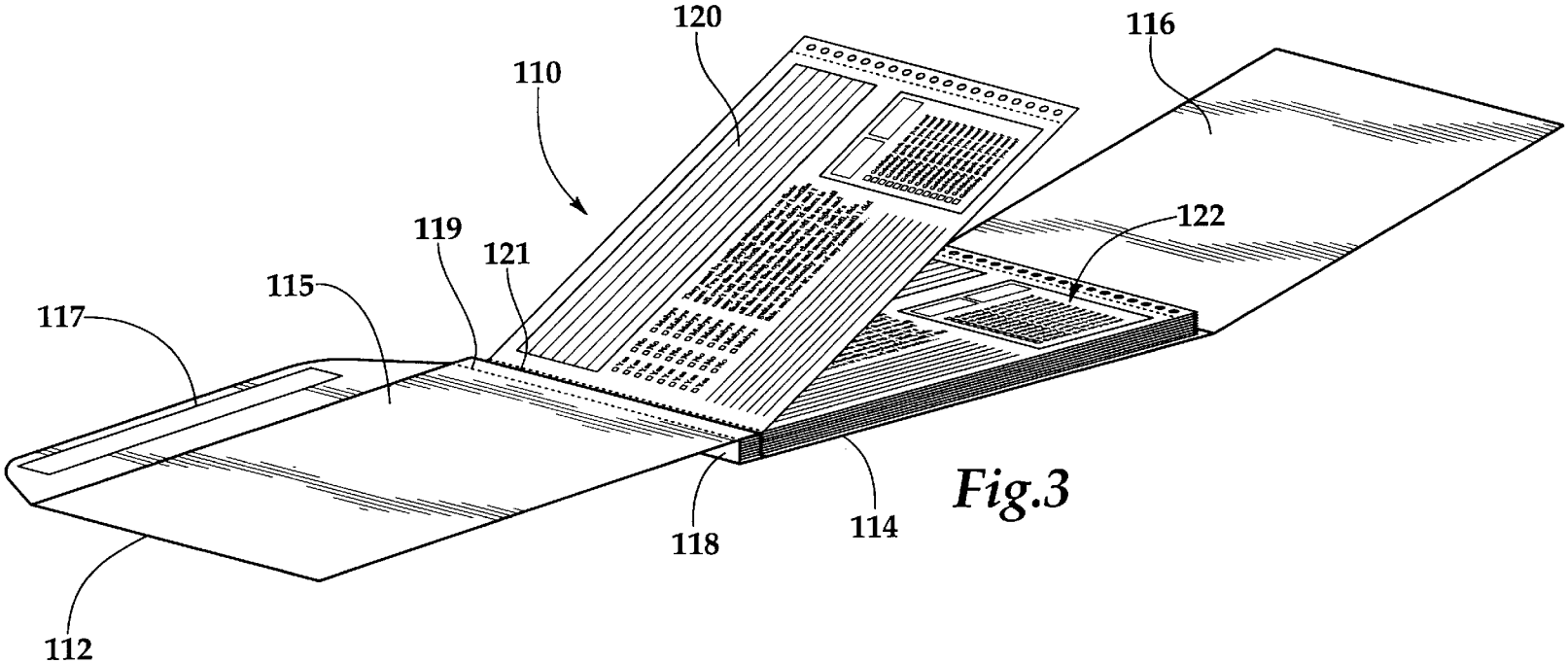
FIG. 3 is a perspective view of the present invention illustrating the dual purpose storage pouch and mailing envelope attached as a cover for the form book of the present invention.
Figure 4:
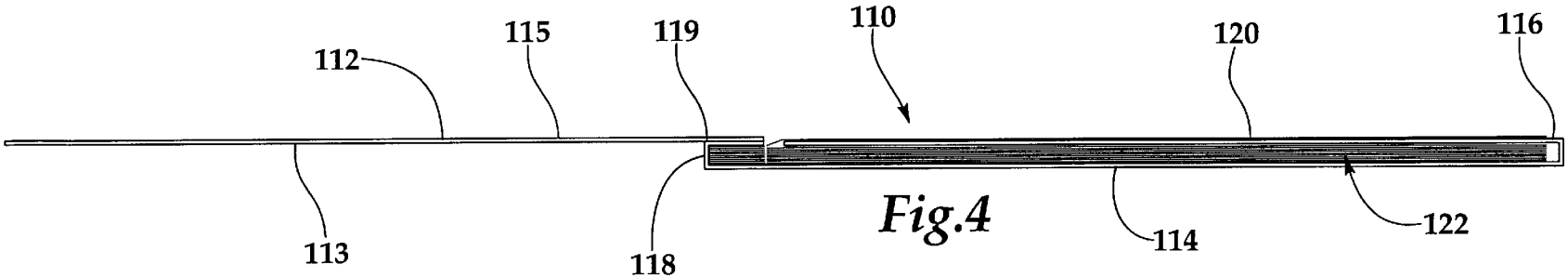
FIG. 4 is a side view of the form book of FIG. 3.

Referring now to FIG. 3, wherein there is illustrated a perspective view of pre-printed form book 110 having a binding 118, a back cover 114 and a foldable extension of the back cover 116 for insertion between the first and second set of pre-printed forms 120 and 122. Pre-printed form sets 120 and 122 are detachably attached to the binding, typically by gluing or stapling or sewing to the binding 118. The pre-printed forms typically include perforations 121 adjacent to the binding 118, wherein one or more of the individual sheets comprising the pre-printed set may be detached from the form book 110.

It will be understood by those skilled in the art that binding 118 may have numerous structural and functional equivalents including an embodiment wherein a portion of the back cover 114 that contacts one of the lateral edges on one side of the pre-printed forms functions as the binding. In another embodiment, the aligned lateral edges on one of the sides of the pre-printed forms is glued, sewn or stapled to the aligned lateral edges of the other pre-printed forms to comprise the binding. In yet another embodiment, such binder devices as spiral wire, spiral plastic, plastic-punch bindings, mechanical grips, mechanical clamps, notebook type binders and other binder devices and types of bindings known in the art may be used.

The form book 110 includes the improved feature of a mailing envelope 112 detachably attached to the binding 118, wherein the envelope 112 serves the dual purpose as a storage pouch (filing system) for one or more pre-printed forms that are detached from book 110 and additionally serves the purpose as a mailing envelope for one or more of the completed pre-printed forms. Envelope 112 includes a closure flap 117 which may include an adhesive, clasp or other closure device known in the art for securing the closure flap 117 to the envelope.

Figures 5, 6, 7:
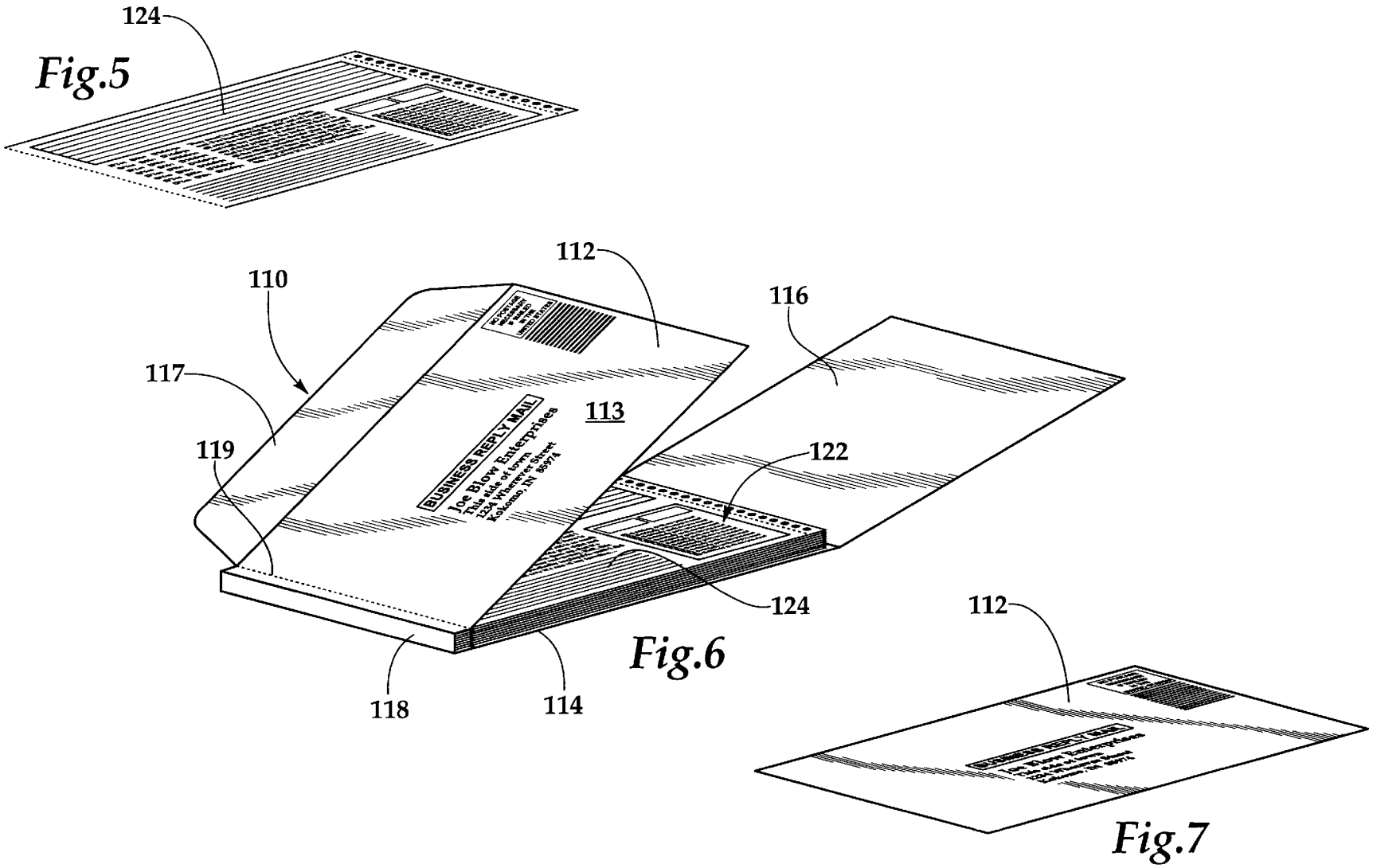
FIG. 5 is a perspective view of one of the pre-printed forms detached and removed from the form book of FIG. 3.
FIG. 6 is a different perspective view of the form book of FIG. 3 illustrating the exterior side of the dual purpose storage pouch and mailing envelope.
FIG. 7 is a perspective view of the mailing envelope of FIG. 6 detached from the form book and ready for mailing.

Referring now to FIG. 6, it can be seen that envelope 112 includes a first side 113 having a pre-printed address of the remote location to which the envelope is to be sent and further may have pre-paid postage included thereon for the convenience of the user of the form book 110.

It will be understood by those skilled in the art that envelope 112 may not necessarily be positioned as the cover of form book 110 and might be positioned as a back cover or possibly be positioned at the beginning of form book 110, but have a typical stiff paper or cardboard cover attached to the binding which serves as a front cover of the form book. One of the key inventive elements of the present invention includes the attachment of the detachable dual purpose storage pouch and mailing envelope to the binding of the book such that the envelope serves a purpose of storing (filing) detached pre-printed forms therein until it is desired that the forms be mailed to a remote location. As will be appreciated by those skilled in the art, the particular location of the envelope 112 in the book is not critical to the invention. By attaching the envelope to the binding of the book, the envelope will not be lost or misplaced and thereby provides a safe and secure storage or filing location for the detached completed pre-printed forms.

At such time that the envelope is detached from the binding, the closure flap is sealed and the envelope is mailed to the remote location.

It will be understood by those skilled in the art that wherein the terms "mailed" or "sent" are used herein. It may encompass not only United States government mail and a United States government pre-paid postal mark, as indicated in the drawings herein, an equivalent commercial service sender such as Federal Express or United Parcel Service could be used instead of the United States government. In such an embodiment, the envelope would include the appropriate information regarding pre-printed addresses and billing information appropriate for the commercial service provider on the envelope 112.

It will be understood by those skilled in the art that the first set of pre-printed forms 120 includes top sheet 124 and at least a second pre-printed form positioned adjacent to and below the first pre-printed form. The form book 110 includes at least a second set of pre-printed forms 122 having at least a third pre-printed form as a top sheet and a fourth pre-printed form positioned adjacent to and below the third pre-printed form comprising a second set of pre-printed forms.

For simplicity's sake, the form book has been illustrated and described herein as having only sets 120 and 122 of pre-printed forms wherein only two sheets are included in each set. However, it will be understood by those skilled in the art that each set of pre-printed forms may include multiple additional pre-printed forms. Typically a form book 110 will include from two to four pre-printed forms in each set (but may include more) The form book 110 will include multiple sets of pre-printed forms.

It will be understood that the cover and envelope of the present invention may be formed from paper, paperboard, cardboard and/or polymeric materials or a combination thereof.

As illustrated in FIGS. 3 through 7, form book 110 is used as follows: An individual positions extendable flap 116 below a first set of forms 120 above a second set of forms 122 and manually writes information into the pre-printed top form 124 in the predetermined spaces. The information is transferred by carbon paper or carbonless paper to underlying second and possibly third, fourth, or more sheets of pre-printed forms positioned below top form 124. One of the forms of first set 120 will typically be detached and given to a customer or a patient. A second copy will be detached and stored (filed) in envelope 112 for future sending to a remote location.

Typically, after all of the sets of the pre-printed forms in the book are used and it is time to send the stored copies of the detached forms to a remote location, the envelope 112 is detached from the form book 110 and the closure flap 117 is sealed and the envelope 112 is mailed or sent via commercial delivery service, such as Federal Express or United Parcel Service, to the remote location.

It will be understood by those skilled in the art that wherein the aforementioned specification has referred to the envelope 112 as a storage pouch, the storage pouch is actually additionally serving as a filing device for the detached copies of the pre-printed forms from the form book 110.

As will be recognized by those skilled in the art, the innovative concepts described in the present application can be modified and varied over a wide range of applications. Accordingly, the scope of patented subject matter should not be limited to any of the specific exemplary teachings discussed, but is instead defined by the following claims.

What is claimed is:

1. An improved pre-printed form book having:

a binding;

a first set of pre-printed forms removably attached to the binding, said first set of forms having:

a first pre-printed form having a plurality of predetermined spaces for receiving manually written information thereon, a second pre-printed form positioned adjacent to and below said first pre-printed form, said second pre-printed form having a plurality of predetermined spaces for receiving the manually written information transferred from the first pre-printed form;

a second set of pre-printed forms removably attached to the binding, said second set of forms having:

a third pre-printed form having a plurality of predetermined spaces for receiving manually written information therein, a fourth pre-printed form positioned adjacent to and below said third pre-printed form, said fourth pre-printed form having a plurality of predetermined spaces for receiving the manually written information transferred from the third pre-printed form; and the improvement comprising:

an envelope removably attached to the binding for storage of at least one of said pre-printed forms having information received thereon, said pre-printed form having been detachably removed from the binding before being inserted into said envelope.

2. The pre-printed form book of claim 1, wherein said envelope is pre-addressed on a first side.

3. The pre-printed form book of claim 1, wherein the envelope includes a closure flap.

4. The pre-printed form book of claim 3, wherein the closure flap includes a means for sealing the closure flap.

5. The pre-printed form book of claim 1, wherein the removably attached envelope is a cover of the form book.

6. The pre-printed form book of claim 1, wherein the removably attached envelope is attached on one end to the binding and is disposed in front of the first set of pre-printed forms.

7. The pre-printed form book of claim 6, further including a back cover including a foldable extension for insertion between the sets of pre-printed forms.

8. The method of using an improved pre-printed form book having a binding, at least one set of pre-printed forms removably attached to the binding, said first set of forms having a first pre-printed form having a plurality of predetermined spaces for receiving manually written information thereon, at least a second pre-printed form positioned adjacent to and below said first pre-printed form, said second pre-printed form having a plurality of predetermined spaces for receiving the manually written information transferred from the first pre-printed form, and a pre-addressed envelope removably attached to the binding for storage of at least one of said pre-printed forms having information received thereon, said method steps including:

(a) manually writing information on at least one set of pre-printed forms;

(b) detaching at least one of said forms having information contained therein from the binding;

(c) storing said form containing information thereon in said envelope;

(d) removing said envelope from the binding; and (e) sending said detached pre-addressed envelope containing the detached pre-printed form having information received thereon.

9. A pre-printed form book having:

a binding;

a first set of pre-printed forms removably attached to the binding, said first set of forms having:

a first pre-printed form having a plurality of predetermined spaces for receiving manually written information thereon, a second pre-printed form positioned adjacent to and below said first pre-printed form, said second pre-printed form having a plurality of predetermined spaces for receiving the manually written information transferred from the first pre-printed form;

a second set of pre-printed forms removably attached to the binding, said second set of forms having:

a third pre-printed form having a plurality of predetermined spaces for receiving manually written information therein, a fourth pre-printed form positioned adjacent to and below said third pre-printed form, said fourth pre-printed form having a plurality of predetermined spaces for receiving the manually written information transferred from the third pre-printed form; and an envelope removably attached to the binding for storage of at least one of said pre-printed forms having information received therein, said pre-printed form having been detachably removed from the binding before being inserted into said envelope, and said envelope is pre-addressed on a first side.

10. The pre-printed form book of claim 9, wherein the envelope includes a closure flap.

11. The pre-printed form book of claim 10, wherein the closure flap includes a means for sealing the closure flap.

12. The pre-printed form book of claim 9, wherein the removably attached envelope is a cover of the form book.

13. The pre-printed form book of claim 9, wherein the removably attached envelope is attached on one end to the binding and is disposed in front of the first set of pre-printed forms.

14. The pre-printed form book of claim 9, further including a back cover including a foldable extension for insertion between the first and second set of pre-printed forms.

* * * * *